US012716105B2

(12) United States Patent
Schlüter et al.

(10) Patent No.: US 12,716,105 B2
(45) Date of Patent: Aug. 25, 2026

(54) METHOD FOR PRODUCING LIQUID PIG IRON FROM A DRI PRODUCT

(71) Applicant: SMS group GmbH, Düsseldorf (DE)

(72) Inventors: Jochen Schlüter, Dortmund (DE); Ralf Nörthemann, Sprockhövel (DE); Thomas Henkel, Duisburg (DE); Paul Tockert, Berburg (LU)

(73) Assignee: SMS group GmbH, Düsseldorf (DE)

( * ) Notice: Subject to any disclaimer, the term of this patent is extended or adjusted under 35 U.S.C. 154(b) by 664 days.

(21) Appl. No.: 17/922,236

(22) PCT Filed: Mar. 2, 2021

(86) PCT No.: PCT/EP2021/055116
§ 371 (c)(1),
(2) Date: Oct. 28, 2022

(87) PCT Pub. No.: WO2021/219277
PCT Pub. Date: Nov. 4, 2021

(65) Prior Publication Data

US 2023/0175087 A1 Jun. 8, 2023

(30) Foreign Application Priority Data

Apr. 30, 2020 (DE) ..... 10 2020 205 493.2

(51) Int. Cl.
*C21B 13/12* (2006.01)
*C21B 5/04* (2006.01)
*C21B 13/00* (2006.01)

(52) U.S. Cl.
CPC ..... *C21B 13/12* (2013.01); *C21B 5/04* (2013.01); *C21B 13/008* (2013.01)

(58) Field of Classification Search
CPC ..... C21B 13/0006; C21B 13/0013; C21B 13/008; C21B 13/12; C21B 13/143; C21B 2400/062; C21B 5/04; C21B 13/14
See application file for complete search history.

(56) References Cited

U.S. PATENT DOCUMENTS 22,692 A 1/1859 Bailey
3,472,649 A 10/1969 Sibakin et al.
(Continued)

FOREIGN PATENT DOCUMENTS

CA 2108816 A1 4/1994
CN 1602363 A 3/2005
(Continued)

OTHER PUBLICATIONS

Faucher S. et al. "Recent developments in dry slag granulation: a path to improving safety and sustainability of the metallurgical sector." 2016. ABW Week. p. 202-213. (Year: 2016).*
(Continued)

*Primary Examiner* — Nicholas A Wang
(74) *Attorney, Agent, or Firm* — Smartpat PLC

(57) ABSTRACT

A method for producing liquid pig iron comprises: i) providing a DRI product with an iron content of at least 75.0 wt. %, a carbon content of at least 0.10 wt. % and a content of acidic and basic slag components, comprising CaO, $SiO_2$, MgO and $Al_2O_3$ of max. 15.0 wt. %; ii) supplying the DRI product, adding slag formers, into an electrically operated smelting unit; iii) optionally supplying further iron and/or carbon components into the electrically operated smelting unit; iv) smelting the DRI product and optionally the further iron and/or carbon components in the presence of the slag formers, so that a liquid pig iron phase and a liquid slag phase are formed; v) adjusting the slag phase such that it has a basicity of ($CaO+MgO/SiO_2$) from 0.95 to 1.5; vi) tapping
(Continued)

the liquid pig iron phase; and vii) tapping and granulating the slag phase.

17 Claims, 3 Drawing Sheets

(56) References Cited

U.S. PATENT DOCUMENTS

| | | | | |
|---|---|---|---|---|
| 3,472,650 | A | | 10/1969 | Jaroslaw et al. |
| 3,690,867 | A | | 9/1972 | Sibakin |
| 4,071,687 | A | | 1/1978 | Nakagawa et al. |
| 4,447,265 | A | | 5/1984 | Schwer |
| 5,445,363 | A | | 8/1995 | Becerra-Novoa et al. |
| 5,634,960 | A | * | 6/1997 | Cowx ..... C21C 5/527 420/29 |
| 5,810,905 | A | | 9/1998 | Shultz |
| 5,946,339 | A | | 8/1999 | True |
| 6,149,709 | A | * | 11/2000 | Uragami ..... C21B 13/14 75/10.63 |
| 6,149,790 | A | | 11/2000 | Oikawa et al. |
| 6,524,362 | B1 | | 2/2003 | Eichberger et al. |
| 6,843,828 | B2 | | 1/2005 | Edlinger |
| 8,391,331 | B2 | | 3/2013 | Eichberger et al. |
| 2002/0002880 | A1 | | 1/2002 | Pavlicevic et al. |
| 2002/0011132 | A1 | | 1/2002 | Pavlicevic et al. |
| 2003/0070507 | A1 | | 4/2003 | Tokuda et al. |
| 2004/0060389 | A1 | | 4/2004 | Roth et al. |
| 2004/0076539 | A1 | | 4/2004 | Ito et al. |
| 2008/0069763 | A1 | | 3/2008 | Tanaka et al. |
| 2008/0236335 | A1 | | 10/2008 | Metius et al. |
| 2010/0180723 | A1 | * | 7/2010 | Fujimoto ..... C21C 7/0087 75/10.61 |
| 2010/0275728 | A1 | | 11/2010 | Lunner et al. |
| 2013/0098202 | A1 | | 4/2013 | Tsuge et al. |
| 2017/0137912 | A1 | † | 5/2017 | Faucher |
| 2018/0274047 | A1 | | 9/2018 | Memoli et al. |
| 2018/0320246 | A1 | | 11/2018 | Al-Tassan et al. |
| 2020/0208230 | A1 | | 7/2020 | Wang et al. |
| 2021/0214812 | A1 | | 7/2021 | Memoli et al. |

FOREIGN PATENT DOCUMENTS

| | | | | |
|---|---|---|---|---|
| CN | 1938434 | A | | 3/2007 |
| CN | 101565769 | | * | 10/2009 |
| CN | 101565769 | A | | 9/2010 |
| CN | 202054853 | U | | 11/2011 |
| CN | 101743330 | A | | 7/2012 |
| CN | 102719577 | A | | 10/2012 |
| CN | 102959095 | A | | 3/2013 |
| CN | 102181781 | A | | 8/2013 |
| CN | 103266194 | A | | 8/2013 |
| CN | 103397140 | A | | 11/2013 |
| CN | 103805727 | A | | 5/2014 |
| CN | 104313214 | | * | 1/2015 |
| CN | 104313214 | A | | 1/2015 |
| CN | 105112584 | A | | 12/2015 |
| CN | 106755660 | A | | 5/2017 |
| DE | 3201608 | | | 9/1982 |
| EP | 1073773 | A1 | | 2/2001 |
| EP | 1144696 | A1 | | 10/2001 |
| EP | 1160337 | A1 | | 12/2001 |
| EP | 1160338 | A1 | | 12/2001 |
| EP | 1298224 | A1 | | 4/2003 |
| EP | 1394275 | A1 | | 3/2004 |
| EP | 1437420 | A1 | | 7/2004 |
| EP | 2660339 | A4 | | 12/2016 |
| WO | 9918245 | A1 | | 4/1999 |
| WO | 9951783 | A1 | | 10/1999 |
| WO | 0172090 | | | 9/2001 |
| WO | 2010128402 | A1 | | 11/2010 |
| WO | 2011151020 | A1 | | 12/2011 |
| WO | 2017207472 | A1 | | 12/2017 |
| WO | 2018014419 | A1 | | 1/2018 |

OTHER PUBLICATIONS

Cheng. Iron-making process and equipment. 2011. Metallurgical industry press. 196. p. 1-12. (Year: 2011).*

Tleugabulov, S. M. et al. "Carburization and decarburization in iron and steel products". 2018. Steel in translation. 48. p. 732-736. (Year: 2018).*

CIPO, Office Action in related Canadian patent application CA 3,181,620, dated May 1, 2024.

JSW Cement Ltd, "Ground Granulated Blast Furnace Slag", pp. 1-4, URL: https://www.jswcement.in/pdf/JSW-GGBS-Technical-Data-Sheet.pdf, retrieved Jan. 25, 2024.

Anonymous, International Application No. EP2021055116 Uploaded document #4 submitted with third party observation dated Aug. 30, 2022 (Aug. 30, 2022).

Anonymous, International Application No. EP2021055116, Uploaded document #11 submitted with third party observation dated Aug. 30, 2022 (Aug. 30, 2022).

Anonymous, PCT Third Party Observation in international application PCT/EP2021/055116, Feb. 28, 2022.

Anonymous, PCT Third Party Observation in international application PCT/EP2021/055116, Aug. 30, 2022.

Anonymous, PCT Third Party Observation in international application PCT/EP2021/055116, Aug. 30, 2022 (2).

Anonymous, PCT Third Party Observation in international application PCT/EP2021/055116, Aug. 30, 2022 (3).

Ironmaking and Steelmaking Slags as Sustainable Adsorbents for Industrial Effluents and Wastewater Treatment: A Critical Review of Properties, Performance, Challenges and Opportunities, Authors: Manchisi James, Matinde Elias, Rowson Neil A, Simmons Mark J H, Simate Geoffrey S, Ndlovu Sehliselo, Mwewa Brian, Publication data: Sustainability, Source info: vol. 12, Nr: 5, p. 2118.

Sauter, D. et al., Dry Atomization of Nickel Laterite Slag, The Conference of Metallurgists, Canadian Institute of Mining, Metallurgy and Petro, 2017, ISBN 978-1-926872-36-0.

Ciocan, Anişoara. "An overview of assessment of the blast furnace slag transformation into value added by-products on basis of its characteristics knowledge." The Annals of "Dunarea de Jos" University of Galati. Fascicle IX, Metallurgy and Materials Science 35, No. 2 (2012): 38-48.

Dutta, Sujay Kumar, and Rameshwar Sah. Alternate Methods of Ironmaking. S. Chand Publishing, 2012.

Faucher, Santiago, Sina Mostaghel, Lily Lai Chi So, and Sang Yoon Oh. "Recent developments in dry slag granulation: a path to improving safety and sustainbility of the metallurgical sector." In Proceedings of ABM Annual Congress, pp. 27-29. 2016.

Iljana, Mikko, Eetu-Pekka Heikkinen, and Timo Fabritius. 2021. "Estimation of Iron Ore Pellet Softening in a Blast Furnace with Computational Thermodynamics" Metals 11, No. 10: 1515. https://doi.org/10.3390/met11101515.

Kekkonen, Marko, and Lauri Holappa. "Comparison of different coal based direct reduction processes." (2000).

Locher, Friedrich W. Cement: principles of production and use. Verlag Bau+ Technik, 2013, pp. 90-96.

Midrex Technologies, Inc., "DRI Products & Applications. Providing flexibility for steelmaking," dated Apr. 2018, retrieved from https://www.midrex.com/wp-content/uploads/MIdrexDRI_ProductsBrochure_4-12-18-1.pdf on Jan. 9, 2026.

Umberto Martini, Dry Granulation of EAF and LF Slags, PowerPoint Presentation, unknown publication date, retrieved from https://www.reusteel.eu/files/Dry%20slag%20granulation%20-%20for%20high%20schools.pdf on Jan. 9, 2026.

Zhang, H., Analysis on Factors Influencing Activity of Ground Granulated Slags, Science and Technology of Baotou Steel, vol. 39, No. 4, Aug. 2013.†

Iron-making Process and Equipment, Cheng, 196, Metallurgical Industry Press, Jan. 2011.†

Donaldson, J.W., et al, "The Smelting of Julian Concentrates by the Strategic-Udy Process Report to Canadian Javelin Limited, St. Johns, Newfoundland, Canada," pp. 1-49, Mar. 6, 1961, Strategic-Udy Processes, Inc., Niagara Falls, NY.†

(56) References Cited

OTHER PUBLICATIONS

Sauter, D., et al., "Dry Atomization of Nickel Laterite Slag," pp. 1-9, 2017, Canadian Institute of Mining, Metallurgy and Petro, The Conference of Metallurgists.†

Faucher, Santiago, et al., "Recent developments in dry slag granulation: a path to improve safety and sustainability of the metallurgical sector", pp. 202-213, Sep. 2016, ABW Week, Rio de Janeiro, Brazil.†

Wallace, J.P., et al., Ironmaking Volume, Making, Shaping and Treating Steel, "Chapter 9: The Blast Furnace Facility and Equipment," pp. 643-698, 1999, The AISE Steel Foundation, Pittsburgh, PA.†

Cameron, et al., Blast Furnace Ironmaking, Analysis, Control, and Optimization, 1st Ed. I., "Chapter 58: Blast Furnace Slag," pp. 633-650, 2019, Elsevier Inc.†

* cited by examiner
† cited by third party

METHOD FOR PRODUCING LIQUID PIG IRON FROM A DRI PRODUCT

TECHNICAL FIELD

The present disclosure relates to a method for producing liquid pig iron, in particular from a directly reduced iron (DRI) product in a smelting unit, a granulated slag and a plant for producing liquid pig iron.

BACKGROUND

Such methods and plants are generally known from the prior art. For example, WO 2017/207472 A1 discloses a method and a plant for producing liquid pig iron from a directly reduced iron (DRI) product that is melted in an electric arc furnace (EAF). The DRI used has a high carbon content, which is present in the form of iron carbide and has an energetically beneficial effect on the molten bath.

Furthermore, European patent applications EP 1 160 338 A1 and EP 1 160 337 A1 disclose a highly energy-saving method for preheating and final reduction of a directly reduced iron (DRI) product. This is smelted in an electric arc furnace (EAF), wherein the CO-containing waste gas produced during the smelting process is reused in the process.

European patent application EP 1 298 224 A1 also discloses a method for producing liquid pig iron in which a directly reduced iron product is melted by means of arc heating. Arc heating mainly involves radiant heating, which leads to improved service life of the refractory material of the melting furnace.

Another method for producing liquid pig iron is known from U.S. Pat. No. 5,810,905. Thereby, in a fluidized bed reactor in the presence of hydrogen, an iron-bearing fine ore is initially converted into iron carbide, which is subsequently supplied to an electric arc furnace (SAF) and melted and liquefied to form liquid pig iron.

Although various methods and plants for producing liquid pig iron from a directly reduced iron product are known from the prior art, there is still a need for improved methods along with plants.

SUMMARY

The present disclosure is based on the object of providing a method that is improved compared to the prior art and a plant for producing liquid pig iron that is improved compared to the prior art.

The object is achieved by a method and by a plant as claimed.

Further advantageous embodiments of the invention are indicated in the dependent formulated claims. The features listed individually in the dependent formulated claims can be combined with one another in a technologically useful manner and can define further embodiments. In addition, the features indicated in the claims are further specified and explained in the description, wherein further preferred embodiments are illustrated.

In accordance with a first aspect, the present disclosure relates to a method for producing liquid pig iron comprising the steps of:

i) providing a directly reduced iron (DRI) product with an iron content of at least 75.0 wt. %, a carbon content of at least 0.10 wt. % and a content of acidic and basic slag components, selected from the group comprising CaO, $SiO_2$, MgO and $Al_2O_3$ of max. 15.0 wt. %, ii) supplying the DRI product, adding slag formers, into an electrically operated smelting unit, iii) optionally supplying further iron and/or carbon components into the electrically operated smelting unit, (iv) smelting the DRI product and optionally the further iron and/or carbon components in the presence of the slag formers, so that a liquid pig iron phase and a liquid slag phase are formed, v) adjusting the slag phase such that it has a basicity of ($CaO+MgO/SiO_2$) from 0.95 to 1.50, (vi) tapping the liquid pig iron phase, and (vii) tapping and granulating the slag phase.

Surprisingly, it has been shown that, via the adjustment of a slag analysis unusual for electrically operated smelting units, such as EAF, SAF or IF units, with a chemical composition similar to that of a blast furnace, slags capable of granulation that can be used industrially are obtained. For example, these form a preferred product in cement production, since they reduce the use of fuels in cement production and thus contribute significantly to reducing $CO_2$ emissions. Thus, the slags do not have to be elaborately reprocessed or even landfilled; rather, they provide a market value that has an economically beneficial effect on the production process.

Moreover, by generating liquid pig iron from the DRI product used and the targeted slag operation, the existing process route for the production of crude steel in an integrated steel mill with a blast furnace, hot metal desulfurization and an LD converter can be maintained. The particular advantage is that the existing blast furnace capacity can be successively supplemented, partially or completely replaced by the method in accordance with the disclosure, wherein neither the metallurgical core process sequences nor the process sequences for treating the byproducts, such as blast furnace slag, desulfurization slag and steel mill slag, have to be significantly changed.

The DRI product can comprise directly reduced iron in the form of so-called premium "DR-grade pellets," or alternatively iron from so-called "blast furnace pellets" with higher slag content, and/or mixtures thereof. Thereby, the increase in slag content increases the amount of slag in the smelting unit. In a preferred embodiment, the directly reduced iron product (DRI product) has an iron content of at least 80.0 wt. %, more preferably at least 85.0 wt. %.

The slag components may vary depending on the ore quality and as such form a fraction of max. 15.0 wt. %, preferably a fraction of max. 12.0 wt. %, in the DRI product used. However, the DRI product is not free of the slag components and preferably comprises them with a fraction of at least 2.0 wt. %, more preferably with a fraction of at least 4.0 wt. % in the DRI product used.

In order to obtain a slag capable of granulation, it must have a vitrification capability, wherein vitrification is generally representable as a function of basicity and composition. It is therefore provided that the slag phase is adjusted such that it has a basicity B3 of ($CaO+MgO/SiO_2$) from 0.95 to 1.50, preferably a basicity B3 of ($CaO+MgO/SiO_2$) from 1.0 to 1.40, more preferably a basicity B3 of ($CaO+MgO/SiO_2$) from 1.0 to 1.25.

In order to facilitate granulation of the slag phase, the slag phase should advantageously have a specific flow behavior. Thereby, it has been shown to be preferable if the slag phase is adjusted such that it has a viscosity of 0.10 to 0.80 Pa*s, preferably a viscosity of 0.30 to 0.50 Pa*s. Viscosity can generally be described as a function of composition along with temperature. In this connection, it is therefore particularly preferred that the slag phase is tapped at a tapping temperature in the range from 1300° C. to 1600° C., more preferably at a tapping temperature in the range from 1350° C. to 1550° C., and most preferably at a tapping temperature in the range from 1400° C. to 1500° C.

In a particularly preferred embodiment, granulation is carried out as wet or dry granulation.

In a further advantageous embodiment, the addition of slag formers is carried out automatically via a process model integrated into a plant automation system, on the basis of which the addition quantity of slag formers to be added is calculated and determined as a function of process parameters. Thereby, the process model is advantageously based on mass and energy balances for melt and slag. Automated addition ensures the necessary adjustments of the desired metal and/or slag parameters. For the complex slag system CaO, $SiO_2$, MgO, $Al_2O_3$ with its numerous crystalline mixed oxides, the process model can also comprise a suitable model for the thermodynamic description of the liquid slag phase, which describes the saturation limits with respect to the oxides and mixed oxides as a function of composition and temperature.

Advantageously, the slag formers are added to the smelting process in such quantities that the properties of flow behavior required for successful granulation along with the ability to vitrify in the liquid slag phase are achieved. As particularly preferred, the slag formers in accordance with step ii) can be supplied to the smelting process up to a fraction of max. 15.0 wt. %, and very particularly preferred up to a fraction of max. 10.0 wt. %, based on the amount of DRI product supplied. Thereby, the slag formers are preferably selected from the group comprising CaO, $SiO_2$, MgO and/or $Al_2O_3$. If necessary, other mixed oxides such as $CaSiO_3$, $Ca_2Si_2O_5$, $Mg_2SiO_4$, $CaAl_2O_4$, etc. can be added.

A slag phase particularly capable of granulation comprises a composition that is formed from at least 70.0 wt. % of the components CaO, MgO and $SiO_2$.

In principle, the process is carried out with a mass fraction of 100% of the DRI product in relation to one batch. Alternatively, additional iron and/or carbon components can be added to the process per batch. To the extent that the addition of further iron and/or carbon components is provided for, they are added in accordance with step iii) up to a fraction of max. 30.0 wt. %, preferably max. 25.0 wt. %, more preferably max. 20.0 wt. %, based on the amount of DRI product supplied. Thereby, the further iron and/or carbon components are selected from the group comprising cold pig iron, charge coal and/or steel scrap.

The directly reduced iron product (DRI product) can be added to the smelting unit in various forms. Preferably, the directly reduced iron product (DRI product) is supplied to the smelting unit in hot form as HDRI product (so-called "hot DRI"), in cold form as CDRI product (so-called "cold DRI"), in hot briquette form as HBI product (so-called "hot-briquetted DRI") and/or in particulate form, preferably with an average particle diameter of max. 10.0 mm, more preferably with an average particle diameter of max. 5.0 mm.

The DRI product produced by the direct reduction method typically has a carbon content between 0.50 and 6.0 wt. %. Therefore, to achieve a pig iron-like analysis in the liquid pig iron phase, it may be necessary to carburize the liquid pig iron phase formed in accordance with step iv) to a carbon content of at least 2.50 wt. %. This can be done by adding cold pig iron or another carbon carrier to the smelting process. The liquid pig iron phase produced in the process is to be loaded into a conventional process route in the further process, for example by supplying it to a pig iron desulfurization plant or a converter for further processing. As such, the carbon content must not exceed a maximum content of 6.0 wt. %, more preferably a maximum of 4.50 wt. %.

The pig iron phase produced in accordance with the method preferably has the following composition in wt. %:

Carbon content 2.50-5.0, more preferably from 3.50-4.50,
Silicon 0.10-0.80, more preferably 0.20-0.50,
Manganese 0.50-5.0, more preferably 0.50-1.50,
along with unavoidable impurities of sulfur and phosphorus of not more than 0.06 each, more preferably not more than 0.04 each.

The DRI product is preferably produced as part of a low-$CO_2$ steelmaking process in a direct reduction plant and, via a conveying device, is supplied to the smelting unit and/or a thermally insulated bunker reservoir under a protective gas atmosphere. Both conventional reformer gas based on natural gas and hydrogen-enriched reformer gas with a hydrogen content of up to 100% can be used as the reduction gas. The hydrogen required for enrichment is preferably produced energetically with the aid of green electricity and is thus $CO_2$-neutral.

In a particularly preferred embodiment, the DRI product and/or the slag formers are supplied to the smelting unit from a, preferably thermally insulated, bunker reservoir. The DRI product temporarily stored in the bunker reservoir is stored under a protective gas atmosphere. Alternatively, the DRI product can be supplied directly from the direct reduction plant to the smelting unit and/or a thermally insulated bunker reservoir under a protective gas atmosphere via a conveying device with metal conveyor belts. Thereby, the DRI product has a temperature of 750 to 800° C.

In a further aspect, the present disclosure further relates to a granulated slag obtained by the method. This comprises the following composition in wt. %:

$SiO_2$ 30.0-50.0, preferably 35.0-40.0
CaO 25.0-50.0, preferably 30.0-43.0
$Al_2O_3$ 5.0-15.0, preferably 8.0-12.0
MgO 2.0-15.0, preferably 4.0-12.0,
along with unavoidable impurities selected from the group comprising iron (Fe), $MnO_2$ and/or sulfur (S).

Preferably, the iron content in the unavoidable impurities amounts to max. 2.0 wt. %, more preferably 1.0 wt. %.

Particularly preferably, the total content of the components $SiO_2$, CaO and MgO in the granulated slag amounts to at least 70.0 wt. %, more preferably 75.0 wt. %, even more preferably 80.0 wt. % and most preferably 85.0 wt. %.

The granulated slag produced in accordance with the method is characterized by having a vitreous solidification fraction of at least 70.0 wt. %, preferably of at least 90.0 wt. %, and more preferably of at least 95.0 wt. %. A glass fraction of more than 90.0 wt. % is preferably achieved by means of wet granulation.

Advantageously, the granulated slag also has a total iron content (Fe) of max. 2.0 wt. %, preferably a total iron content (Fe) of max. 1.0 wt. %.

Depending on the application of the granulated slag, any minor components that may be present may also be of importance and are found in the eluates (chloride, sulfate, heavy metals, etc.) during the environmental testing of suitability for use. In a preferred embodiment, the granulated slag can therefore have an eluate allocation value of 0 (unrestricted incorporation) or 1 (restricted open incorporation) in accordance with the valid statutory guidelines (NGS—TR Boden of LAGA M20 from May 2013).

In accordance with a further aspect, the present disclosure also relates to a plant for producing liquid pig iron, comprising a direct reduction plant for producing a directly reduced iron product (DRI product), an electrically operated smelting unit in which the directly reduced iron product (DRI product) can be smelted, along with a conveying device via which the directly reduced iron product (DRI product) can be transported from the direct reduction plant to the smelting unit.

The smelting unit is preferably designed in the form of an electric arc furnace (EAF), a submerged arc furnace (SAF) or an induction furnace (IF).

The conveying device is preferably designed in the form of a metal conveyor belt and has a protective gas atmosphere.

Furthermore, the plant advantageously has a thermally insulated bunker reservoir.

The invention and the technical environment are explained in more detail below with reference to the figures. It should be noted that the invention is not intended to be limited by the exemplary embodiments shown. In particular, unless explicitly shown otherwise, it is also possible to extract partial aspects of the facts explained in the figures and combine them with other components and findings from the present description and/or figures. In particular, it should be noted that the figures and in particular the size relationships shown are only schematic. Identical reference signs designate identical objects, such that explanations from other figures can be used as a supplement if necessary.

DETAILED DESCRIPTION

Figure 1:
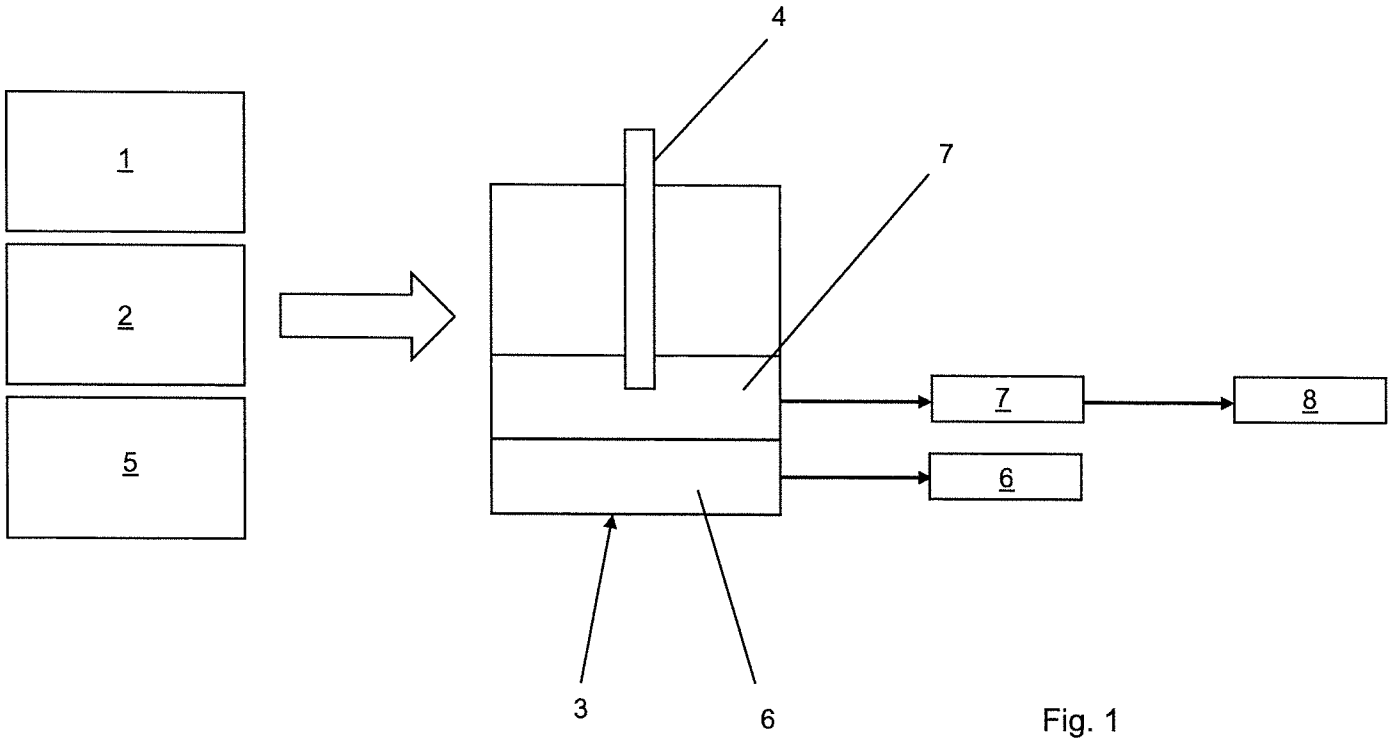
FIG. 1 shows a schematic view of a flow chart on the basis of which the method for producing liquid pig iron is explained.

In accordance with FIG. 1, the method for producing liquid pig iron is explained in a possible embodiment on the basis of a flow chart.

For the production of liquid pig iron, a directly reduced iron product 1 (DRI product) is initially provided, which, in the embodiment shown here, has an iron content of 80.0 wt. %, a carbon content of 3.0 wt. % and a content of acidic and basic slag constituents selected from the group comprising CaO, $SiO_2$, MgO and $Al_2O_3$ of not more than 12.0 wt. % in total and is present in the form of a hot DRI product with a temperature of approximately 750-800° C.

Figure 2:
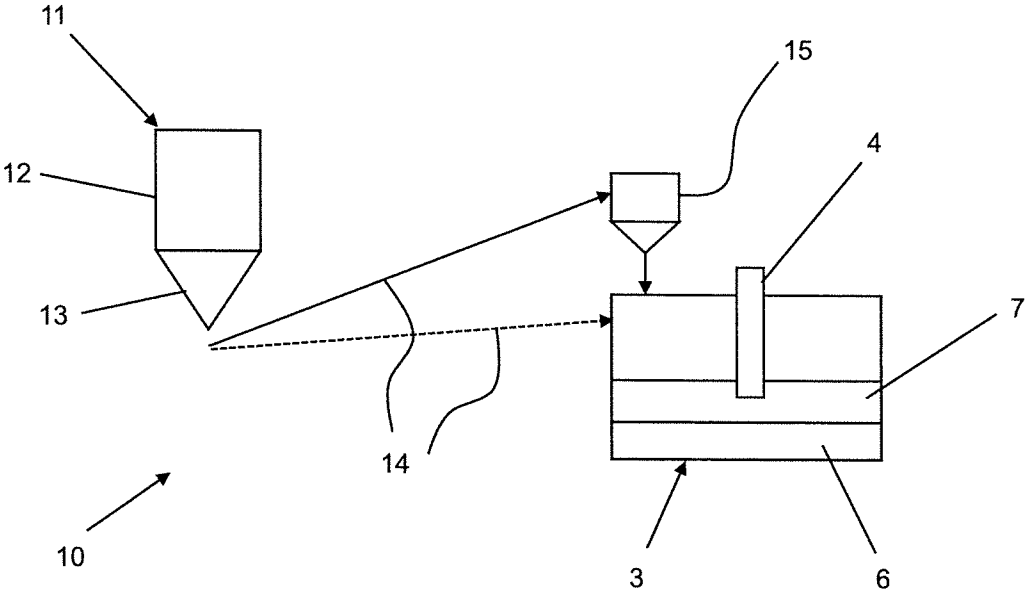
FIG. 2 shows a highly simplified schematic view of a plant in accordance with a first embodiment.
Figure 3:
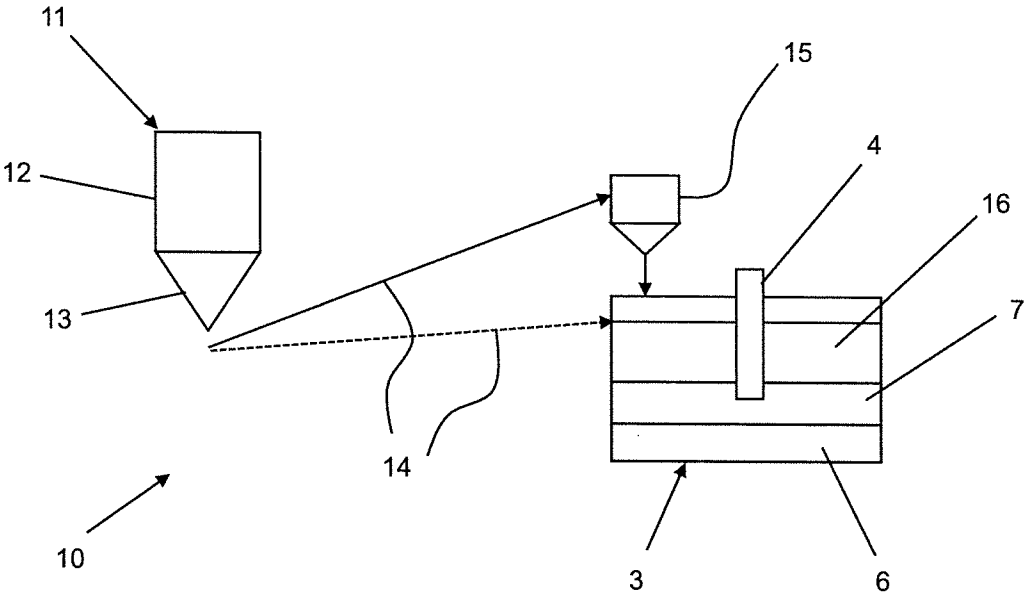
FIG. 3 shows a highly simplified schematic view of a plant in accordance with a second embodiment.

For example, the DRI product 1 can be produced as part of a low-$CO_2$ steelmaking process in a direct reduction plant 11, as shown in FIGS. 2 and 3.

In the next step, the DRI product 1 is supplied to an electrically operated smelting unit 3, adding slag formers 2. In the embodiment shown in the present case, the slag formers 2 are selected from the group comprising CaO, $SiO_2$, MgO and $Al_2O_3$ and are added to the smelting unit 3 in an amount of up to 10.0 wt. %, based on the amount of DRI product supplied. In the present case, the smelting unit 3 is designed in the form of an electric arc furnace (EAF) and comprises at least one electrode 4, such as, for example, a carbon electrode.

The process shown in FIG. 1 can in principle be carried out with a mass fraction of 100% of the DRI product based on a batch charge. However, in the embodiment shown, further iron and/or carbon components 5 are added to the smelting unit 3 in the form of coal and steel scrap. In the present example, the mass fraction of the iron and carbon components 5 amounts to 20.0 wt. %, based on the amount of DRI product supplied.

The mixture of DRI product 1, slag former 2, and iron and carbon components 5 is then melted with the aid of electric current, such that a liquid pig iron phase 6 and a liquid slag phase 7 are formed.

By adding the slag formers 5, the slag phase 7 is adjusted such that, in the embodiment shown here, it has a basicity B3 of ($CaO+MgO/SiO_2$) from 0.95 to 1.25 along with a viscosity of 0.30 to 0.50 Pa*s. To the extent that such slag parameters are achieved, the slag phase 7 is tapped at a tapping temperature in the range from 1350° C. to 1550° C. and then granulated. In a final step, the liquid pig iron phase 6 is tapped off and supplied, for example, to a converter steel mill for further processing.

The tapped pig iron phase 6 has the following composition in wt. %:

Carbon content 3.50,
Silicon 0.3,
Manganese 0.50,
Residual iron along with unavoidable impurities of sulfur and phosphorus of max. 0.04 each.

The tapped slag phase 7 is processed via wet granulation into a granulated slag 8, which has the following composition in wt. %:

$SiO_2$ 45.0,
CaO 40.0
$Al_2O_3$ 8.0,
MgO 5.0,
along with unavoidable impurities comprising iron, $MnO_2$ and sulfur (S) a total of less than 2.0.

The granulated slag is characterized by having a vitreous solidification fraction of 95.0 wt. % and a total iron (Fe) content of less than 1.0 wt. %.

FIG. 2 shows a highly simplified schematic view of a plant 10 in accordance with a first embodiment.

The plant 10 for producing liquid pig iron comprises a direct reduction plant 11 for producing the directly reduced iron product 1. The direct reduction plant 11 comprises a first upper part, which forms a reduction shaft 12, and a second lower part, which forms a cooling section 13. Conventional reformer gas based on natural gas, coke gas or other metallurgical gases along with hydrogen-enriched reformer gas with a maximum hydrogen content of up to 100% can be used as the reduction gas. The hydrogen required is advantageously produced from green electricity in a $CO_2$-neutral manner.

The DRI product 1 produced in the present direct reduction plant 11 can have a variable carbon content depending on the hydrogen content in the reduction gas. In order to have a pig iron-like analysis, the carbon content can be raised by selective injection of natural gas for cooling purposes in the lower cooling section 13.

Furthermore, the plant 10 comprises an electrically operated smelting unit 3, in which the directly reduced iron product 1 (DRI product) can be smelted, along with a conveying device 14, via which the directly reduced iron product 1 can be transported from the direct reduction plant 11 to the smelting unit 3.

In the present case, the smelting unit 3 is designed in the form of an electric arc furnace (EAF).

The DRI product 1 produced in the direct reduction plant 11 can be supplied directly to the smelting unit 3 via the conveying device 14, which in the present case is designed in the form of a metal conveyor belt and has a protective gas atmosphere, as this is shown based on the dashed line.

Preferably, the DRI product 1 is initially supplied via the conveying device 14 to a thermally insulated bunker reservoir 15 under a protective gas atmosphere, from which it is then supplied, preferably automatically, to the smelting unit 3.

FIG. 3 shows a highly simplified schematic view of the plant 10 in a second embodiment. In contrast to the embodiment shown in FIG. 2, the smelting unit 3 is designed in the form of a submerged arc furnace (SAF). This process is characterized by the presence of a foamed slag phase 16, which surrounds the electrode 4, in the smelting unit 3.

LIST OF REFERENCE SIGNS

1 Directly reduced iron product/DRI product
2 Slag former
3 Smelting unit
4 Electrode
5 Iron and/or carbon components
6 Liquid pig iron phase
7 Liquid slag phase
8 Granulated slag
10 Plant
11 Direct reduction plant
12 Reduction shaft
13 Cooling section
14 Conveying device
15 Bunker reservoir
16 Foam slag

The invention claimed is:

1. A method for producing liquid pig iron, comprising:
i) providing a directly reduced iron product (1) (DRI product) with an iron content of at least 75.0 wt. %, a carbon content of at least 0.10 wt. %, and a content of acidic and basic slag components, selected from the group consisting of CaO, $SiO_2$, MgO and $Al_2O_3$, of max. 15.0 wt. %;
ii) supplying the DRI product (1) and slag formers (2) into an electrically operated smelting unit (3);
iii) supplying further iron and/or carbon components (5) in an amount up to 30 wt. % relative to the DRI product into the electrically operated smelting (3) unit;
iv) smelting the DRI product (1) and optionally the further iron and/or carbon components (5) in presence of the slag formers (2), so that a liquid pig iron phase (6) and a liquid slag phase (7) are formed;
v) adjusting the slag phase (7) such that it has a basicity of ($CaO+MgO/SiO_2$) from 0.95 to 1.5;
vi) tapping the liquid pig iron phase (6); and
vii) tapping and granulating the slag phase (7),
wherein upon granulation, the slag exhibits a composition comprising 35.0-40.0 wt. % $SiO_2$, 30.0-43.0 wt. % CaO, 8.0-12.0 wt. % $Al_2O_3$, and 4.0-12.0 wt. % MgO, with unavoidable impurities including Fe, $MnO_2$, and/or S.

2. The method according to claim 1,
wherein the slag phase (7) is adjusted such that it has a basicity of ($CaO+MgO/SiO_2$) from 1.0 to 1.25.

3. The method according to claim 1,
wherein the slag phase (7) is adjusted such that it has a viscosity of 0.30 to 0.50 Pa*s.

4. The method according to claim 1,
wherein the slag phase (7) is tapped at a tapping temperature in the range from 1300° C. to 1600° C.

5. The method according to claim 1,
wherein the slag formers (2) are selected from the group consisting of CaO, $SiO_2$, MgO, $Al_2O_3$, and mixed oxides thereof.

6. The method according to claim 1,
wherein the slag formers (2) in accordance with step ii) are supplied up to a fraction of max. 10.0 wt. %, based on an amount of the DRI product.

7. The method according to claim 1,
wherein the iron and/or carbon components (5) in accordance with step iii) are supplied up to a fraction of max. 20.0 wt. %, based on an amount of the DRI product.

8. The method according to claim 1,
wherein granulation is carried out as wet or dry granulation.

9. The method according to claim 1,
wherein supplying the slag formers (2) is carried out automatically via a process model integrated into a plant automation system, and
wherein a quantity of the slag formers (2) is calculated by the process model and determined as a function of process parameters.

10. The method according to claim 1,
wherein the directly reduced iron product (1) is supplied to the smelting unit (3)
in hot form as HDRI product,
in cold form as CDRI product,
in hot briquette form as HBI product and/or
in particulate form with an average particle diameter of max. 10.0 mm.

11. The method according to claim 1,
wherein the liquid pig iron phase (6) formed in accordance with step iv) is carburized to a carbon content of at least 2.50 wt. %.

12. The method according to claim 1,
wherein the DRI product (1) and/or the slag formers (2) are supplied to the smelting unit (3) from a thermally insulated bunker reservoir (15).

13. The method according to claim 1,
wherein the DRI product (1) is produced in a direct reduction plant (11) and is supplied to the smelting unit (3) and/or a bunker reservoir (15) under a protective gas atmosphere via a conveying device (14).

14. The method according to claim 1, further comprising:
viii) using the granulated slag phase (7) for cement production.

15. The method according to claim 1, wherein granulating the slag phase (7) is performed by wet granulation.

16. A method for producing liquid pig iron, comprising:
i) providing a directly reduced iron product (1) with an iron content of at least 75.0 wt. %, a carbon content of at least 0.10 wt. %, and a content of acidic and basic slag components of max. 15.0 wt. %, the acidic and basic slag components comprising CaO, MgO, $SiO_2$, and $Al_2O_3$;
ii) supplying the directly reduced iron product (1) and slag formers (2) into an electrically operated smelting unit (3);
iii) supplying further iron and/or carbon components (5) in an amount up to 30 wt. % relative to the directly reduced iron product into the electrically operated smelting (3) unit, the further iron and/or carbon components (5) being selected from the group consisting of cold pig iron, charge coal, and steel scrap;
iv smelting the directly reduced iron product (1) and the further iron and/or carbon components (5) in presence of the slag formers (2), so that a liquid pig iron phase (6) and a liquid slag phase (7) are formed;

v) optimizing the liquid slag phase (7) for industrial use by adjusting the slag phase (7) such that it has a basicity of ($CaO+MgO/SiO_2$) from 1.0 to 1.25 and controlling at least one of slag viscosity and tapping temperature so that, upon granulation, the slag exhibits a vitreous solidification fraction of at least 90 wt. % and a composition comprising 30.0-50.0 wt. % $SiO_2$, 25.0-50.0 wt. % CaO, 5.0-15.0 wt. % $Al_2O_3$, and 2.0-15.0 wt. % MgO, with unavoidable impurities including Fe, $MnO_2$ and/or S;

vi) tapping the liquid pig iron phase (6); and vii) tapping and granulating the slag phase (7).

17. The method according to claim 16, wherein the further iron and/or carbon components (5) comprise steel scrap.

* * * * *